US009523501B2

(12) United States Patent
Happe

(10) Patent No.: US 9,523,501 B2
(45) Date of Patent: Dec. 20, 2016

(54) GAS REGULATING FITTING

(71) Applicant: MERTIK MAXITROL GMBH & CO. KG, Thale (DE)

(72) Inventor: Barbara Happe, Gernrode (DE)

(73) Assignee: Mertik Maxitrol GmbH & Co. KG, Thale (DE)

( * ) Notice: Subject to any disclaimer, the term of this patent is extended or adjusted under 35 U.S.C. 154(b) by 471 days.

(21) Appl. No.: 14/350,477

(22) PCT Filed: Oct. 22, 2012

(86) PCT No.: PCT/EP2012/004420
§ 371 (c)(1),
(2) Date: Apr. 8, 2014

(87) PCT Pub. No.: WO2013/060442
PCT Pub. Date: May 2, 2013

(65) Prior Publication Data

US 2014/0272740 A1 Sep. 18, 2014

(30) Foreign Application Priority Data

Oct. 24, 2011 (EP) ..... 102011116797

(51) Int. Cl.
*F23Q 3/00* (2006.01)
*F23N 5/26* (2006.01)

(52) U.S. Cl.
CPC ..... *F23Q 3/006* (2013.01); *F23N 5/26* (2013.01); *F23N 2035/24* (2013.01)

(58) Field of Classification Search
CPC ..... F23N 2035/24; F23N 5/26
(Continued)

(56) References Cited

U.S. PATENT DOCUMENTS 4,168,719 A 9/1979 Renshaw
5,156,557 A 10/1992 Okafuji et al.
(Continued)

FOREIGN PATENT DOCUMENTS

DE 10 2010 019 960 A1 11/2011
GB 2251342 A 7/1992
(Continued)

OTHER PUBLICATIONS

International Search Report of WO2013060442A1 dated Mar. 28, 2013, 4 pages.

*Primary Examiner* — Avinash Savani
(74) *Attorney, Agent, or Firm* — Howard & Howard Attorneys PLLC

(57) ABSTRACT

The aim of the invention is to provide a gas regulator fitting that ensures simple manual operation. In particular, activation and deactivation, respectively, are to be made possible with one motion. Furthermore, the invention aims to ensure that even in the event the voltage source malfunctions, the gas regulator fitting will be deactivated. To accomplish this, an ignition safety magnet (34) is excited by a current flowing over a first micro switch (13) when the gas regulator fitting is activated by means of the manual actuation of a tappet (10) having selector contours (15; 16) in a longitudinal direction against the force of a return spring (12). A second micro switch (14), which is series-connected in the thermal current to circuit, thereby assumes the open position thereof since both micro switches (13; 14) can be operated by means of the selector contours (15; 16) assigned thereto, such that the first micro switch (13) is closed before the second micro switch (14) is opened, whereas when the tappet (10) assumes the initial position thereof under the force of the return spring (12), the second micro switch (14) is closed before the first micro switch (13) is opened.

2 Claims, 2 Drawing Sheets

Figure 1:
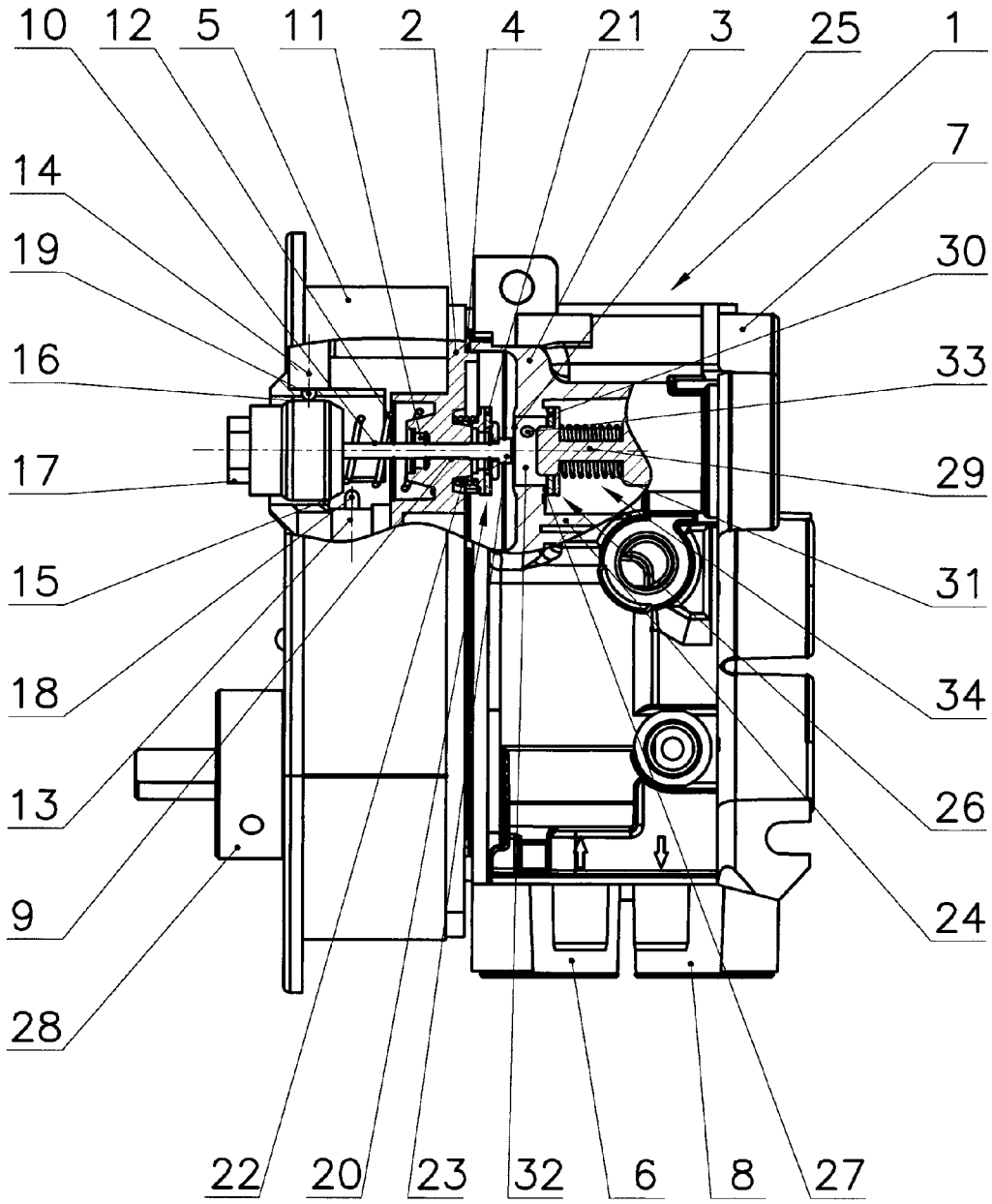

(58) Field of Classification Search
USPC ..... 126/39 BA; 431/59, 255
See application file for complete search history.

(56) References Cited

U.S. PATENT DOCUMENTS

| | | | |
|---|---|---|---|
| 5,289,633 | A | 3/1994 | Okafuji et al. |
| 5,345,978 | A | 9/1994 | Okafuji et al. |
| 6,029,705 | A | 2/2000 | Happe |
| 7,507,085 | B2 | 3/2009 | Happe et al. |
| 2006/0207654 | A1 | 9/2006 | Huang |
| 2013/0048109 | A1 | 2/2013 | Happe |

FOREIGN PATENT DOCUMENTS

| | | | |
|---|---|---|---|
| WO | 9922175 | A1 | 5/1999 |
| WO | 2004079265 | A1 | 9/2004 |

GAS REGULATING FITTING

TECHNICAL FIELD

The invention relates to a gas regulator fitting with electronic ignition for a gas-fired heating device according to the preamble to the first claim.

PRIOR ART

Gas regulator fittings for a gas-fired heating device such as a gas heating stove, a gas fireplace or the like are available in a wide range of designs. They serve to ignite and regulate a gas flow flowing to a burner.

For example, a gas regulator fitting with electronic ignition with an electronic control unit fed by a voltage source is described in the German patent application DE 10 2010 019 960 A1. A thermoelectric ignition safety valve and a main valve which jointly serve both as a safety pilot and as a means of splitting the gas flow into proportions for a main burner and a pilot light, are accommodated in a segmented housing, together with and additional functional components. A tappet protruding from the gas-conducting chamber of the housing is arranged axially to the ignition safety valve and the main valve, and can be activated in a longitudinal direction against the force of a return spring such that the ignition safety valve is in the open position and the main valve is in the closed position.

A micro switch connected to the electronic control unit is arranged on the housing and is switched on a manual actuation of the tappet in a longitudinal direction against the force of the return spring, thereby sending an electrical signal to the electronic control unit. When the gas regulator fitting is deactivated, the electronic control unit is then activated, whereas when the gas regulator fitting is activated the electronic control unit is deactivated by the breaking of the thermal current circuit via a relay, and the resultant interruption of the holding current flowing to the thermoelectric ignition safety valve.

This arrangement is disadvantageous in that a current to be provided by the voltage source must be available to enable the gas regulator fitting to be deactivated correctly. This means that in the event of a failure of the voltage source, for example if a battery is discharged, deactivation does not take place which may represent a safety problem.

SUMMARY OF THE INVENTION

The object of the invention is to ensure a simple means of manually operating a gas regulator fitting with electronic ignition of the gas flow according to the preamble of the first claim, enabling activation and deactivation each to be carried out in one motion. Furthermore, deactivation of the gas regulator fitting is to be ensured even in the event of a failure of the voltage source.

The problem is solved according to the invention in that an ignition safety magnet is excited by a current flowing over a first micro switch when the gas regulator fitting is activated and in that a second micro switch is arranged on the housing and assumes its open position on a manual actuation of the tappet in a longitudinal direction against the force of the return spring. This micro switch is series-connected in the thermal current circuit.

Both micro switches can be operated in such a way via the selector contours assigned to them and located on the tappet that the first micro switch is closed before the second micro switch is opened, whereas the second micro switch is closed before the first micro switch opens when the tappet assumes its initial position under the force of the return spring on completion of the manual actuation.

This arrangement provides a solution eliminating the disadvantages of the prior art referred to above. Furthermore, the state can easily be changed by a manual activation of the tappets i.e. activation or deactivation is possible. In addition, deactivation is ensured even in the event of a failure in the voltage source.

An advantageous embodiment of the invention is set out in the dependent claim.

An advantageous embodiment of the gas regulator fitting has thus proved to be an arrangement where the two micro switches are attached in such a position on the upper part that the selector contours are identical. This makes it possible to produce the selector contour as a simple-to- manufacture turning contour on the operating control.

EXECUTION EXAMPLE

Figure 2:
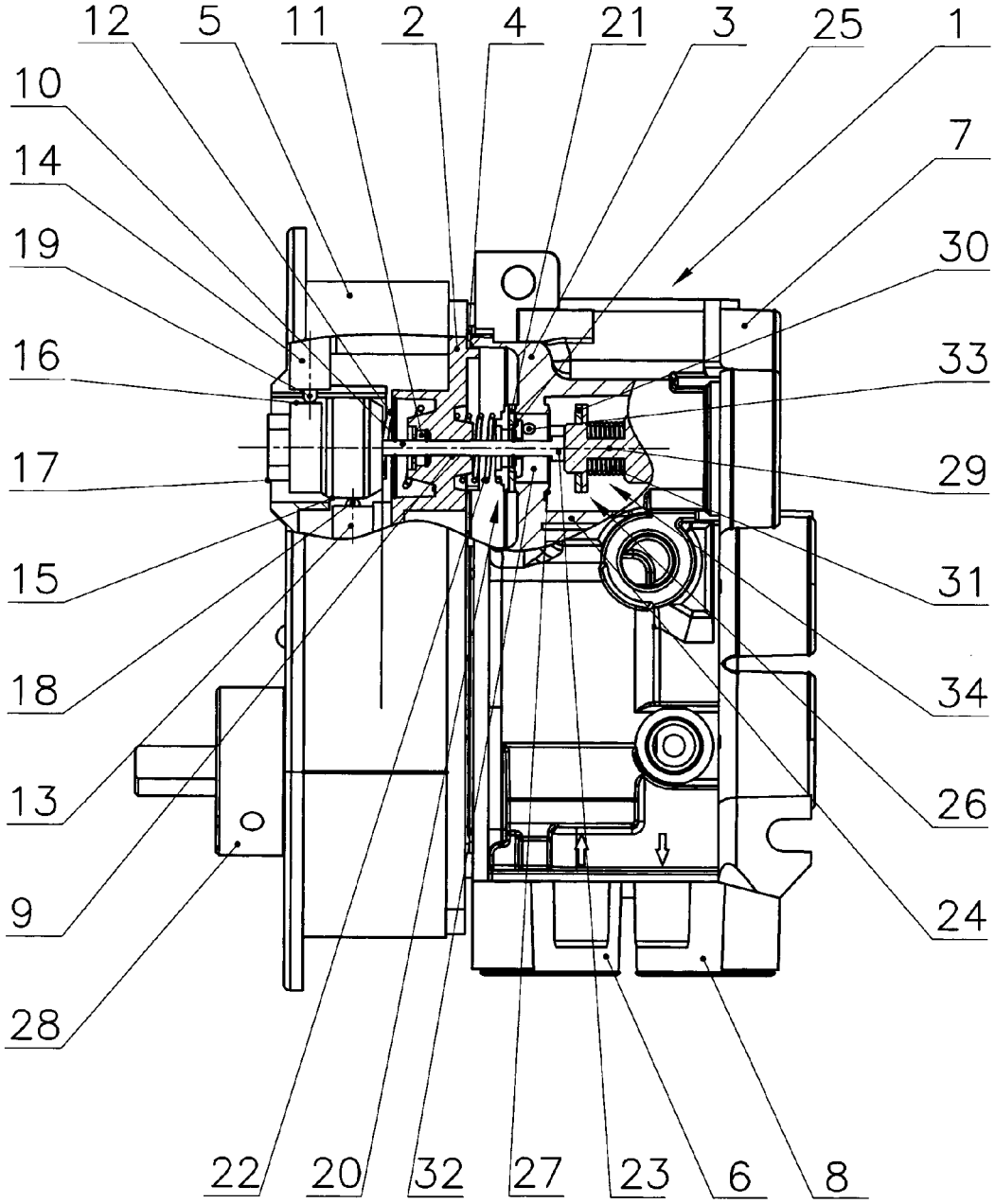

The gas regulator fitting according to the invention fitting is now to be described in more detail below using an execution example supplemented by drawings which show:

FIG. 1 a partially cutaway view of a version of a gas regulator fitting in the closed position, FIG. 2 a partially cutaway view of a version of a gas regulator fitting on a manual actuation of the tappet.

The exemplary embodiment of the gas regulator fitting according to the invention shown in the drawings is a switching and regulatory device intended for installation in gas-fired heating devices or the like. It enables a burner to be operated and monitored by regulating the volume of gas flowing to the burner. In this execution example the burner comprises a pilot light and a main burner, neither of which is shown.

The gas regulator fitting according to the invention shown in the drawings and described below comprises a housing 1 in which various functional units are located, some of which can be operated externally by operating controls 17; 28. The housing comprises an upper part 2 and a lower part 3, between which a flat seal 4 guarantees external gastightness, together with a cover 5. In addition, the housing 1 has a gas inlet 6, an ignition gas outlet 7 and a main gas outlet 8. The gas regulator fitting has the following functional units:

Start-up with safety pilot

Control unit for the volume of gas flowing to the main burner

The device is activated by an electronic control unit (not shown) which is located in this example together with a voltage source in a separate housing (not shown) that can be installed in any location.

To start up the device a tappet 10, whose end extends into the interior of the housing 1, is longitudinally guided in a bearing 9 of the upper part 2, with the necessary gastightness ensured by an 0-ring 11 for example. The movement of the tappet 10 in a longitudinal direction is possible here only against the force of a return spring 12 supported in the upper part 2.

In addition, a first micro switch 13, electrically connected to the electronic control unit, and a second micro switch 14, series-connected in the thermal current circuit, are attached between upper part 2 and cover 5, with the micro switch 13 in the open position and the micro switch 14 in the closed position when the gas regulator fitting is in the closed position. This is achieved by means of a selector contour 15 for the switching element 18 of the first micro switch 13 and a selector contour 16 for the switching element 19 of the second micro switch 14. Both selector contours 15; 16 are located on the outer surface of an operating control 17 attached to the part of the tappet 10 protruding outwards.

As in this execution example, the two micro switches 13; 14 can be conveniently be attached in a different position on the upper part 2 such that the selector contours 15; 16 are identical, enabling them to be produced as a simple-to-manufacture turning contour on the operating control 17.

A valve disc 21 forming part of a main valve 20 is displaceably guided on the area of the tappet 10 protruding into the interior of the upper part 2 and is supported on a stop 23 located on the tappet 10 under the force of a closing spring 22, which rests on the one hand against the upper part 2 and on the other hand against the valve disc 21. The initial position to be assumed under the force of the return spring 12 is achieved by the valve disc 21 of the main valve 20 resting against the upper part 2.

The interior of the part of the housing 1 formed by upper part 2 and lower part 3 is divided by a partition 24 into different chambers. The partition 24 is aligned with the extension of the tappet 10 and has an aperture 32 whose side facing the upper part 2 forms the valve seat 25 for the valve disc 21, thereby forming in combination with valve disc 21 the main valve 20, whereas the other side of the aperture 32 forms a valve seat 27 forming part of a ignition safety valve 26. An ignition gas borehole 33 leading to the ignition gas outlet 7 flows into the aperture 32 between both valve seats 25/27. The ignition safety valve 26 is controlled by a thermoelectric ignition safety magnet 34 which is arranged gastight in a bearing of the housing 1 and located downstream of the gas inlet 6. The thermoelectric ignition safety magnet 34 acts on an anchor which is rigidly connected to a valve rod 29 to which the valve disc 30 of the ignition safety valve 26 is attached. The thermoelectric ignition safety magnet 34 can be excited via the electronic control unit as well as via a thermocouple exposed to the pilot light.

Incidentally, the structure and mode of operation of the ignition safety magnet 34 are known to those skilled in the art so that a description of additional details can be dispensed with. The only additional aspect to be noted here is that a return spring 31 endeavours to withdraw the anchor from the ignition safety magnet 34 by means of the valve disc 30 serving as a spring hanger.

The control unit for the volume of gas flowing to the main burner, which is not shown as it is known to those skilled in the art, is located within the housing 1 in the direction of flow downstream of the start-up. It usually comprises a switch which regulates the volume of gas flowing to the main burner.

The switch for example is constructed in such a manner that a modulating control and a stepwise on and off switching in the partial load area are effected respectively by an initial and a second valve, with the partial load throughput limited by an adjustable nozzle.

A longitudinally movable operating rod connected to the switch protrudes from the housing 1 and is connected to an operating control 28, with the housing 1 providing at the same time a bearing for said switch.

The mode of operation of the gas regulator fitting is as follows:

FIG. 1 shows the gas regulator fitting in its deactivated state. The operating control 17 is in its initial position under the effect of the return spring 12. Although the main valve 20 is opened in this position, the ignition safety magnet 34 is not excited so that the ignition safety valve 26 is closed and no gas can flow to the burner.

In order to activate the gas regulator fitting the tappet 10 must be moved in its longitudinal direction by the operating control 17 against the force of the return spring 12 so that the position shown in FIG. 2 is assumed.

In this process the main valve 20 is initially closed and subsequently the ignition safety valve 26 is opened wide enough to allow the anchor to rest against the ignition safety magnet 34. The ignition gas can now flow via the ignition gas borehole 33 to the ignition gas outlet 7 and from there to the pilot light via an ignition gas line that is not shown.

The first micro switch 13 is closed at the same time via the selector contour 15 and the switching element 18, and an electrical signal received by the electronic control unit causes on the one hand current to be supplied to the ignition safety magnet 34 via the first micro switch 13, and on the other hand causes the gas flowing out at the pilot light to be ignited via the electronic control unit. In addition, the switching element 19 of the second micro switch 14 is activated via the selector contour 16, so that the micro switch 14 assumes its open position, thereby breaking the thermal current circuit.

As soon as the pilot light is lit, a holding current is made available to the ignition safety magnet 34 via a thermocouple controllable by the pilot light. The current cannot however yet flow because the thermal current circuit has been broken. It is only when manual actuation of the operating control 17 has ended that the tappet resumes its original position, the main valve 20 is opened and the micro switches 13; 14 are activated. The first micro switch 13 does not open until after the second micro switch has already closed in order to ensure the ignition safety magnet 34 remains excited from this point via the applied thermoelectric voltage.

The switch can now be activated by the operating control 28 in a known manner, a process in which the second valve initially opens abruptly. The constant volume of gas restricted by an aperture flows to the main burner through a main gas line (also not shown) via the main gas outlet 8, and is ignited by the pilot light. The flames burn at a minimal level. On further activation of the operating control 28 the volume of gas flowing to the main gas burner is uniformly increased as the first valve now continuously opens, thereby uniformly increasing the volume of gas flowing through the first valve.

When the operating control 17 is operated when the gas regulator fitting is activated, the main valve 20 is closed, thereby interrupting the gas flow to the main burner. The thermal current circuit is manually broken via the operation of the micro switch 14 which also occurs simultaneously. The ignition safety magnet 34 is no longer excited and thus the ignition safety valve 26 is no longer held. As soon as the operating control 17 is no longer activated and returns to its initial position, the ignition safety valve 26 also assumes its closed position. The gas regulator fitting is in the deactivated state.

The gas regulator fitting according to the invention is not of course restricted to the execution example described. Indeed, changes, modifications and combinations can be made without departing from the scope of the invention.

For example the main burner referred to and described above for the volume of gas flowing to the main burner can of course be dispensed with whenever a constant volume of gas is to flow to the main burner and it is not necessary to regulate this gas flow. On the other hand, the gas regulator fitting can for example have additional functional units, such as a pressure regulator or the like.

| List of reference numerals | |
|---|---|
| 1 | Housing |
| 2 | Upper part |
| 3 | Lower part |
| 4 | Flat seal |
| 5 | Cover |
| 6 | Gas inlet |
| 7 | Ignition gas outlet |
| 8 | Main gas outlet |
| 9 | Bearing |
| 10 | Tappet |
| 11 | O-ring |
| 12 | Return spring |
| 13 | First micro switch |
| 14 | Second micro switch |
| 15 | Selector contour for the first micro switch |
| 16 | Selector contour for the second micro switch |
| 17 | Operating control |
| 18 | Switching element of the first micro switch |
| 19 | Switching element of the second micro switch |
| 20 | Main valve |
| 21 | Valve disc |
| 22 | Closing spring |
| 23 | Stop |
| 24 | Partition |
| 25 | Valve seat |
| 26 | Ignition safety valve |
| 27 | Valve seat |
| 28 | Operating control |
| 29 | Valve rod |
| 30 | Valve disc |
| 31 | Return spring |
| 32 | Aperture |
| 33 | Ignition gas borehole |
| 34 | Ignition safety magnet |

The invention claimed is:

1. Gas regulator fitting with electronic ignition for a gas-fired heating device or the like with an electronic control unit fed by a voltage source, a thermoelectric ignition safety valve (26) controllable by a ignition safety magnet (34) and a main valve (20) which jointly serve both as a safety pilot and as a means of splitting the gas flow into proportions for a main burner and a pilot light, and are accommodated with additional, secondary functional elements in a segmented housing (1), a tappet (10) arranged axially to the ignition safety valve (26) and the main valve (20), which protrudes from the gas-conducting chamber of the housing (1) and can be activated in a longitudinal direction against the force of a return spring (12) such that the ignition safety valve (26) is in the open position and the main valve (20) is in the closed position, and with a micro switch (13) arranged on the housing (1) and connected to the electronic control unit, said micro switch assuming its closed position on a manual actuation of the tappet (10) in a longitudinal direction against the force of the return spring (12) so that when the gas regulator fitting is in its deactivated state an electrical signal is received by the electronic control unit, whereby said control unit is activated and thus the gas flowing through the opened ignition safety valve (26) is ignited, characterised in that on activation of the gas regulator fitting the ignition safety magnet (34) is excited by a current flowing across the micro switch (13), and that a second micro switch (14) series-connected in the thermal current circuit is arranged on the housing (1) and assumes its open position on a manual actuation of the tappet (10) in a longitudinal direction against the force of the return spring (12) and that both micro switches (13; 14) can be operated in such a way via the selector contours (15; 16) assigned to them and located on the tappet (10) that the first micro switch (13) is closed, before the second micro switch (14) is opened, whereas the second micro switch (14) is closed, before the first micro switch (13) is opened when the tappet (10) assumes its initial position under the force of the return spring (12).

2. Gas regulator fitting according to claim 1, characterised in that both micro switches (13; 14) are attached in such a position on the upper side (2) that the selector contours (15; 16) located on the operating control (17) are identical.

* * * * *